United States Patent [19]

Matsuda

[11] 4,232,693

[45] Nov. 11, 1980

[54] FOLDING UMBRELLA

[76] Inventor: Toshio Matsuda, 4-7 Miyamaecho Sanjo, Nara-shi, Nara-ken, Japan

[21] Appl. No.: 955,484

[22] Filed: Oct. 27, 1978

[30] Foreign Application Priority Data

Oct. 28, 1977 [JP] Japan ..... 52-129958

[51] Int. Cl.[3] ..... A45B 25/18

[52] U.S. Cl. ..... 135/36 F; 135/25 R

[58] Field of Search ..... 135/20, 33 R, 33 C, 135/34, 36 F, 44, 22, 25 R

[56] References Cited

U.S. PATENT DOCUMENTS

| | | | |
|---|---|---|---|
| 661,366 | 11/1900 | Carlson | 135/25 R |
| 907,231 | 12/1908 | Hayden | 135/25 R |
| 1,352,332 | 9/1920 | Weinberg | 135/44 |
| 3,818,920 | 6/1974 | Oyama | 135/20 R |

*Primary Examiner*—Reinaldo P. Machado

*Attorney, Agent, or Firm*—Koda and Androlia

[57] ABSTRACT

A folding umbrella including a central shaft, a movable frame consisting of ribs coupled to one end of the shaft, an unfurlable material coupled to the frame and a belt swingingly coupled at one end to an edge of the material whereby the umbrella may be furled not only when the umbrella is folded up but also when the umbrella is not folded up.

2 Claims, 6 Drawing Figures

FOLDING UMBRELLA

BACKGROUND OF THE INVENTION

1. Field of the Invention

This invention relates to umbrellas and more particularly to folding umbrellas.

2. Prior Art

In the prior art there exists a folding umbrella. The prior art folding umbrella includes a belt to furl the umbrella. The belt is placed on the umbrella such that the umbrella can only be furled when it is folded. In other words, the belt can be utilized to furl the umbrella only when the ribs of the umbrella frame are folded and cannot be used when the ribs are straight. Accordingly, when the umbrella is not folded, the material of the umbrella is very loose and this causes contact with the clothes of the user, etc. Especially on a rainy day, it is very unpleasant to get your clothes wet by contacting with the wet surface of an unfolded umbrella. Furthermore, it is also inconvenient that in order to furl the umbrella one has to fold it all up.

SUMMARY OF THE INVENTION

Accordingly, it is an object of the present invention to provide a belt for furling a folding umbrella which allows the umbrella to be furled even when the umbrella is not folded.

The above-mentioned features and objects of the present invention are accomplished by a unique folding umbrella. The folding umbrella includes a central shaft, a movable frame consisting of ribs coupled to one end of the shaft, an unfurlable material coupled to the frame and a belt swingingly coupled at one end to an edge of the material whereby the umbrella may be furled not only when the umbrella is folded but also when the umbrella is not folded up.

BRIEF DESCRIPTION OF THE DRAWINGS

The above-mentioned features and objects of the present invention will become more apparent with reference to the following description taken in conjunction with the accompanying drawings wherein like reference numerals denote like elements, and in which.

DETAILED DESCRIPTION OF THE INVENTION

Figure 1:
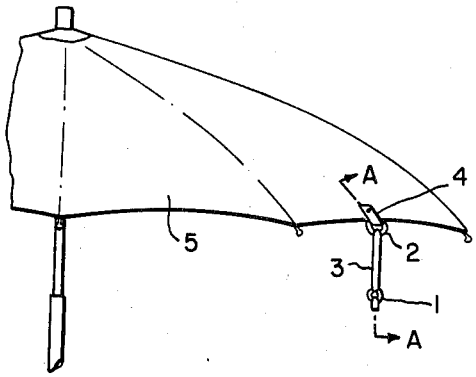
FIG. 1 is a partial view of an open folding umbrella in accordance with the teachings of the present invention.
Figure 2:
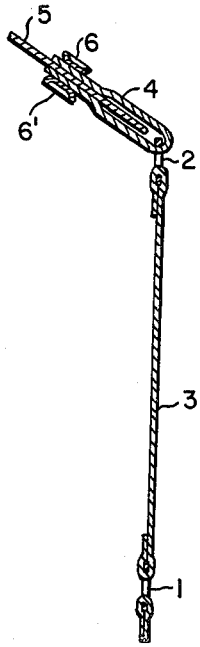
FIG. 2 is a sectional view along the lines A—A of FIG. 1.

Referring to the FIGS., shown in FIGS. 1 and 2 is a first embodiment of a folding umbrella in accordance with the teachings of the present invention. In the FIGS., a belt 3 is swingingly coupled to the rim or edge of the material 5 of the umbrella. The belt 3 includes a hooking ring 1 at one end thereof and is swingingly coupled to the rim of the material 5 by swing ring 2 coupled to the other end of the belt 3 and a guide 4 coupled to the rim of the material 5. The guide 4 is in the form of a loop and extends from the front side of the material 5 to the back side of the material 5. The swinging ring 2 passes through the loop of the guide 4 and thereby couples the belt 3 to the guide 4. Metal fittings 6 and 6′ are fixed to said material 5 at a mounting position and are utilized to hook the hooking ring 1 to furl the umbrella.

Figure 3:
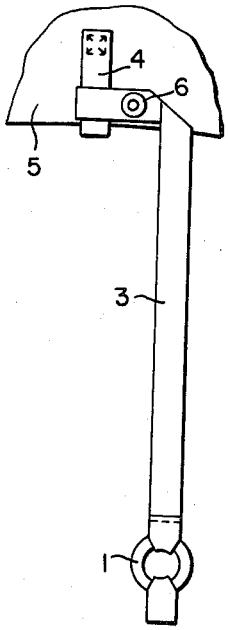
FIGS. 3 and 4 illustrate other embodiments of a folding umbrella in accordance with the teachings of the present invention.
Figure 4:
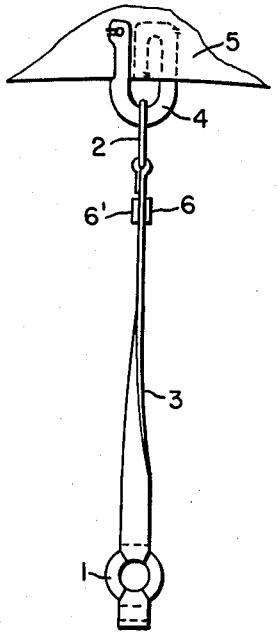

It should be apparent that the hooking ring 1 and the metal fittings 6 and 6′ could be replaced by a male hook and a female hook. Also, it is not necessary to fix the metal fittings 6 and 6′ at the same mounting position. It would be possible to fix one of the metal fittings 6 or 6′ at one mounting position and the other metal fitting at some other mounting position such as on the belt 3. Such an arrangement is shown in FIG. 3. Furthermore, instead of using the swinging ring, one end of the belt 3 can be directly coupled to the guide 4 so as to allow it to swing freely as is shown in FIG. 3. The guide 4 can be a cloth belt, cloth string or a metallic one.

Figure 5:
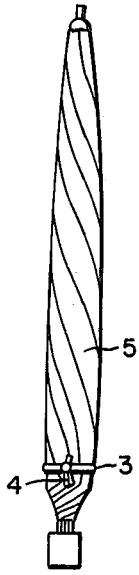
FIG. 5 illustrates the umbrella material furled with a belt in accordance with the teachings of the present invention when the folded umbrella is not folded.

Referring to FIG. 5, shown therein is another embodiment of a folding umbrella in accordance with the teachings of the present invention. This embodiment is substantially similar to that shown in FIGS. 1 and 2 except that instead of utilizing a flat folded cloth member for the guide 4, the guide 4 is made from plastic, metal, etc., and is shaped in the shape of a U with a hook and the guide 4 is stitched or coupled in some manner to the rim of the material 5. Furthermore, in this embodiment, the metal fittings 6 and 6′ are provided on the belt 3.

Figure 6:
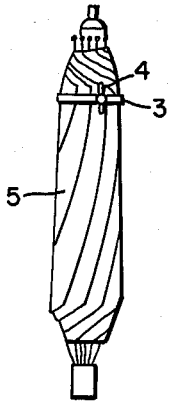
FIG. 6 illustrates the umbrella material folded with a belt in accordance with the teachings of the present invention when the umbrella is folded.

In operation, the umbrella may be furled by means of the belt 3. In particular, as shown in FIG. 5, the umbrella may be furled by means of the belt 3 when the umbrella is not folded and the ribs are straight, as is shown in FIG. 6. In addition, the umbrella may be furled by means of belt 3 when the umbrella is folded up as is shown in FIG. 7.

As is apparent from the above description, the present invention is very effective to furl the umbrella with one belt on the rim of the material whether or not the umbrella is folded or unfolded. Therefore, the present invention prevents a wet umbrella from contacting the clothes of the user in a crowded vehicle or store even when the umbrella is unfolded.

It should be apparent to one skilled in the art that the above described embodiments are merely illustrative of but a few of the many possible specific embodiment which represents the application of the principles of the present invention. Numerous and varied other arrangements can be readily devised by those skilled in the art without departing from the spirit and scope of the invention.

I claim:

1. A folding umbrella comprising a collapsible central shaft, a movable frame consisting of foldable ribs coupled to one end of the shaft, an unfurlable material coupled to the foldable ribs, a guide mounted on the edge of said material such that said guide loops around an edge of the material and a belt swingingly coupled at one end to said guide whereby the umbrella may be furled not only when the umbrella is folded up but also when the umbrella is not folded up.

2. A folding umbrella according to claim 1 further comprising a swinging ring coupled to the guide and to one end of said belt.

* * * * *